US006443600B1

(12) United States Patent
Wu

(10) Patent No.: US 6,443,600 B1
(45) Date of Patent: Sep. 3, 2002

(54) VARIABLE-TYPE LAMP SHADE ASSEMBLY STRUCTURE

(76) Inventor: Wen-Chang Wu, No. 10, Lane 191, Hsi Hsin Street, Chung Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 09/836,195

(22) Filed: Apr. 18, 2001

(51) Int. Cl.[7] ..... F21V 1/06
(52) U.S. Cl. ..... 362/352; 362/351; 362/358
(58) Field of Search ..... 362/351, 352, 362/358

(56) References Cited

U.S. PATENT DOCUMENTS 5,375,048 A * 12/1994 Barnes ..... 362/352
6,315,434 B1 * 11/2001 Long ..... 362/352

* cited by examiner

*Primary Examiner*—Thomas M. Sember

(74) *Attorney, Agent, or Firm*—Troxell Law Office PLLC

(57) ABSTRACT

A variable-type lamp shade assembly structure comprised of a top ring, a two-part bottom ring, sequentially distributed frame members between the top ring and the bottom ring, and a fabric material lamp shade covering the exterior periphery of the frame members. The two-part bottom rod of the bottom ring has at its conjoinment area a coupling section of a flat shape and with a hole in the center and, furthermore, a link is installed on each of the two ends of the coupling section to provide for folding the bottom ring at the coupling section. The bottom ring has sequentially disposed on its circumferential edge curved retaining rods that provide for slipping the fastening sections of the frame members over the retaining rods and thereby maintaining them in position. As such, the top and the bottom ends of the frame members are respectively supported onto the top ring and the bottom ring to prevent the separation of the frame members from the top and the bottom rings. When packaging, the frame members must be first brought down flat and the bottom ring is folded, thereby achieving ease of assembly and, furthermore, minimizing storage area to effectively reduce shipping costs.

6 Claims, 6 Drawing Sheets

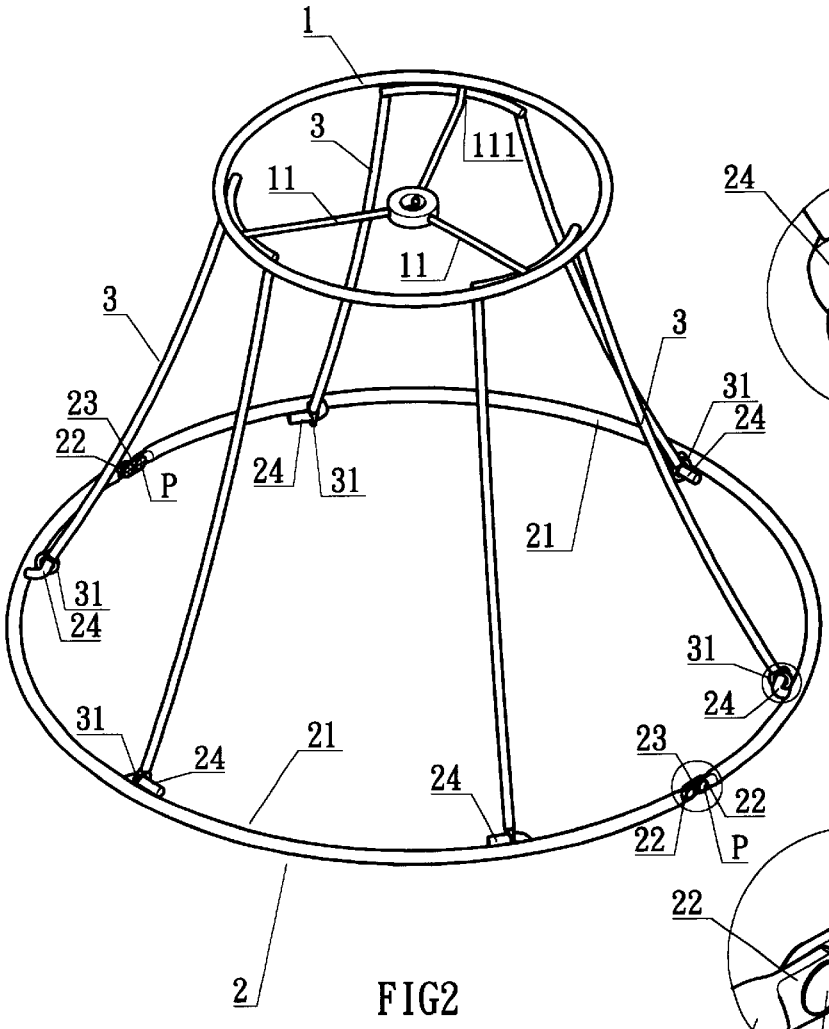
FIG2
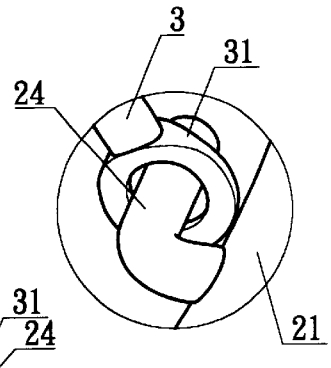
FIG2-B
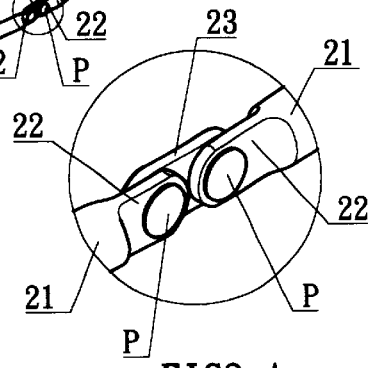
FIG2-A

VARIABLE-TYPE LAMP SHADE ASSEMBLY STRUCTURE

BACKGROUND OF THE INVENTION

1) Field of the Invention

The invention herein relates to a variable-type lamp shade assembly structure in which the bottom ring consists of a two-part bottom rod and, furthermore, the two-part bottom rod has at its conjoinment area a coupling section and a link is installed on each of the two ends of the coupling section to provide for folding the bottom ring at the coupling section; the bottom ring has sequentially disposed on its circumferential edge curved retaining rods that provide for slipping the fastening sections of frame members over the retaining rods and maintaining them in position; as such, the top and the bottom ends of the frame members are respectively supported onto the top ring and the bottom ring to prevent the separation of the frame members from the top and the bottom ring, when packaging, the frame members must be first brought down flat and the bottom ring is folded, thereby achieving ease of assembly and, furthermore, minimizing storage area to effectively reduce shipping costs 2) Description of the Prior Art A conventional lamp shade 5, referring to FIG. 6, typically has its frame members permanently fixed between the top ring and the bottom ring to form a lamp shade structure; however, since its structure is imperfect, the numerous practical shortcomings that result and await further correction and improvement by the industry are represented by the following elaboration.

Since the conventional lamp shape 5 is a structural entity of an unyielding shape, when it is packaged in a carton, the lamp shade 5 cannot be forcefully diminished in size and no reduction in large volume storage area is possible, which leads to a proportional increase in product shipping costs and results in greater overhead.

SUMMARY OF THE INVENTION

The primary objective of the invention herein is to provide a variable-type lamp shade assembly structure in which the two-part bottom rod of the bottom ring has at its conjoinment area a coupling section of a flat shape and with a hole in the center and, furthermore, a link is installed on each of the two ends of the coupling section to provide for folding the bottom ring at the coupling section; the bottom ring has sequentially disposed on its circumferential edge curved retaining rods that provide for slipping the fastening sections of the frame members over the retaining rods and maintaining them in position and, as such, the top and the bottom ends of the frame members are respectively supported onto the top ring and the bottom ring to prevent the separation of the frame members from the top and the bottom rings; when packaging, the frame members must be first brought down flat and the bottom ring is folded, thereby achieving ease of assembly and, furthermore, minimizing storage area to effectively reduce shipping costs.

Another objective of the invention herein is to a variable-type lamp shade assembly structure in which after the assembly of the lamp shade framework is completed, the exterior periphery of the frame members are covered with a fabric material lamp shade, wherein the said lamp shade has elastic tape at the leading and trailing ends and is fitted over the exterior periphery of the frame members and, furthermore, the elastic tape section is tightly secured around the top ring and the bottom ring to thereby effectively achieve an attractive appearance.

Yet another objective of the invention herein is to a variable-type lamp shade assembly structure in which the said bottom ring consists of a two-part bottom rod having symmetrical left and right segments, fitted onto the free end at each of the opposing extremities is a coupling sleeve, the coupling sleeve is punch molded and fabricated by bending into a structural arrangement consisting of two round sleeves, one small and one large; the large sleeve is fitted onto each free end of the two-part bottom rod; and elastic cordage is then installed on the opposing small sleeve ends to provide for the folding of the two-part bottom rod at the elastic cordage position.

BRIEF DESCRIPTION OF THE DRAWINGS

FIG. 2 is an isometric drawing of the invention.

FIG. 2-A is a magnified view of the bottom ring and frame member section.

FIG. 2-B is an isometric drawing of the two-part bottom rod conjoining arrangement.

FIG. 5A is partial magnified view of the two-part bottom rod conjoinment area.

DETAILED DESCRIPTION OF THE INVENTION

Figure 1:
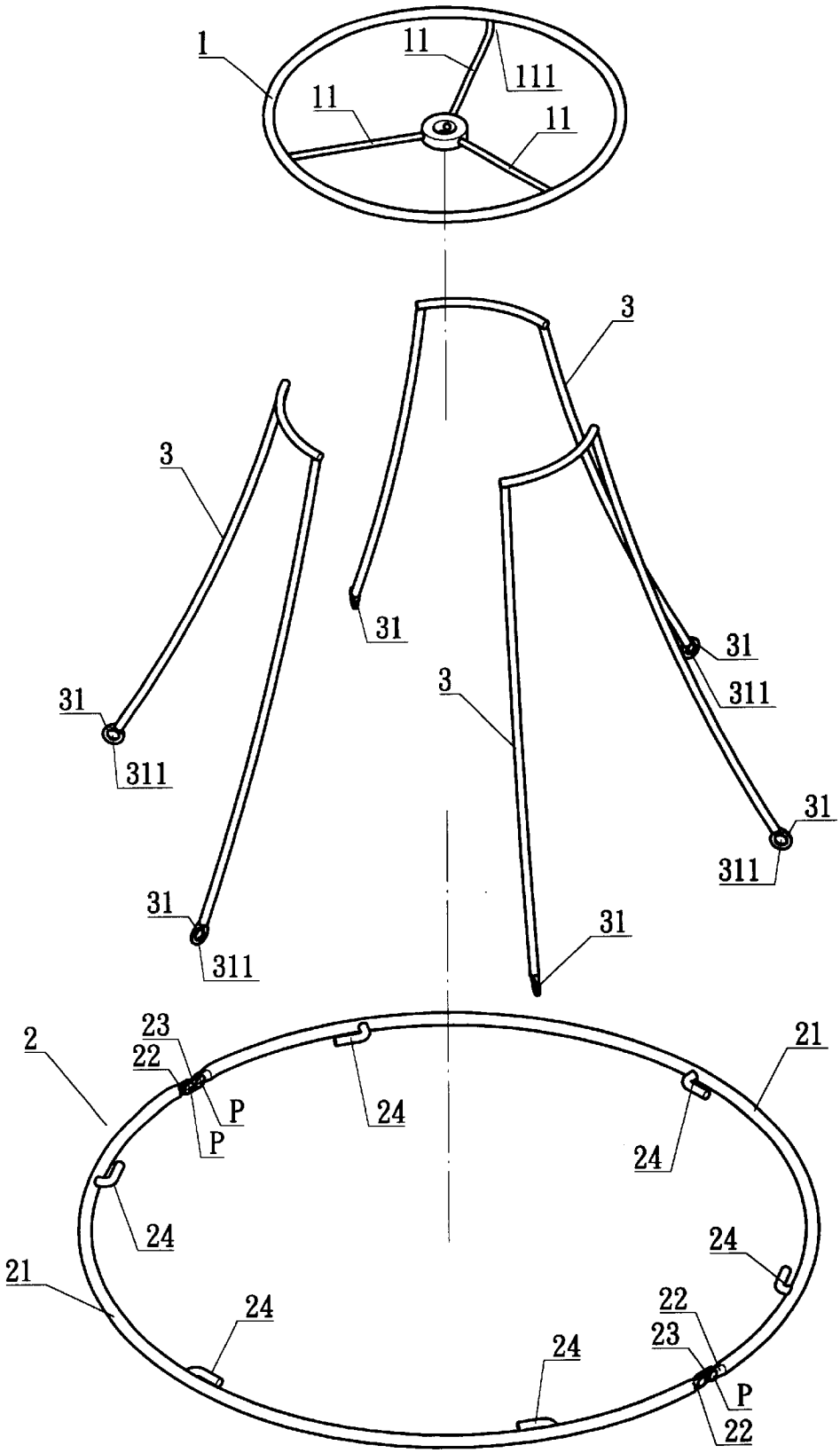
FIG. 1 is an exploded drawing of the invention.

Referring to FIG. 1 and FIG. 2, the structural arrangement of the invention herein is comprised of a top ring 1, a two-part bottom ring 2, and sequentially distributed frame members 3 between the top ring 1 and the bottom ring 2, of which:

The said top ring 1 is of annular metal construction and, furthermore, is situated against a cylindrical lamp pipe structure, with the top ring 1 having support rods 11 extending from the center towards its circumference, and the support rods 11 are aligned with the frame members 3 at the circumferential edge of the top ring 1 and an inclosing space 111 is formed by upward bending such that after the frame members 3 are assembled, this provides for positioning the top ends of the frame members 3 against the bottom edge of the inclosing spaces 111.

The said bottom ring 2 consists of a two-part bottom rod 21 in which each segment is semicircular and, furthermore, of a left and right symmetrical arrangement, the two-part bottom rod 21 having at its conjoinment area a continuously punch molded coupling section 22 of a flat shape, with a hole punched in the center of each coupling section 22 that provides for the insertion of a rivet P through each of the holes of the two-part bottom rod 21 and the installation of a link 23 on them to thereby provide for folding the two-part bottom rod 21 at the coupling section 22 (as shown in FIG. 2B); the bottom ring 2 has sequentially disposed on its circumferential edge curved retaining rods 24 that provide for slipping the fastening sections 31 of the frame members 3 over the retaining rods 24 (as shown in FIG. 2A); as such, the top and the bottom ends of the frame members 3 are respectively supported against the top ring 1 and the bottom ring 2 to prevent the separation of the two ends of the frame members 3 from the top and the bottom rings 1 and 2.

The said frame member 3 top ends are positioned against the bottom edge of the support rod 11 inclosing spaces 111, fastening sections 31 of a flat shape are continuously punch molded at the bottom ends of the frame members 3 and, furthermore, continued punching molds the fastening sections 31 into a round shape and forms a through-hole 33 in the center of each fastening section 31 to provide for slipping the fastening sections 31 onto the bottom ring 2 retaining rods 24 and positioning them onto the bottom ring 2.

Figure 3:
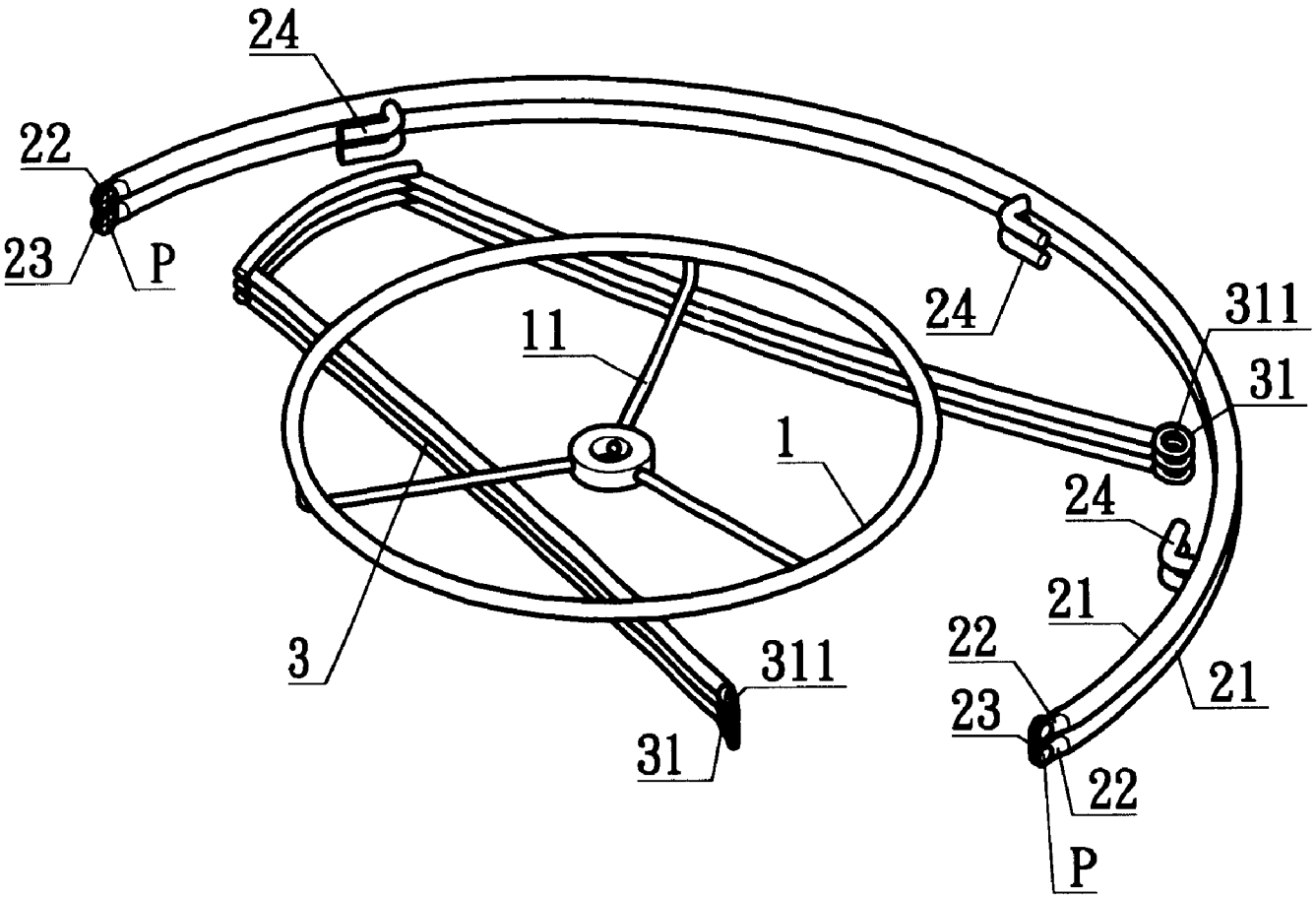
FIG. 3 is a cross-sectional drawing of the enshrouded lamp shade fabric surfacing of the invention herein.

Referring to FIG. 3, the drawing of the enshrouded lamp shade fabric surfacing of the invention herein, after the assembly of the lamp shade framework is completed, the exterior periphery of the frame members 3 are covered with a fabric material lamp shade 4, wherein the said lamp shade 4 has elastic tape 41 at the leading and trailing ends and is fitted over the exterior periphery of the frame members 3 and, furthermore, the elastic tape 41 section is tightly secured around the top ring 1 and the bottom ring 2, thereby ensconcing the lamp shade framework and effectively achieving an attractive appearance.

Figure 4:
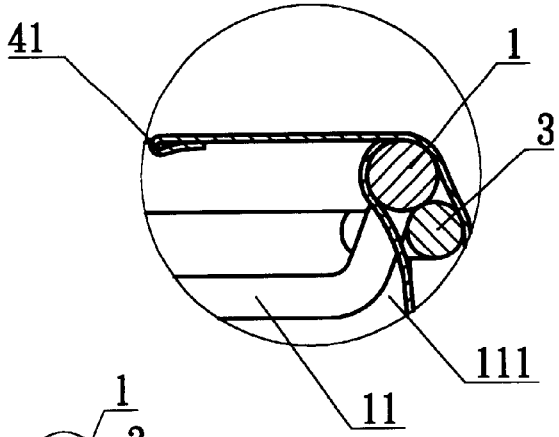
FIG. 4 is an isometric drawing of the invention herein when folded.
Figure 4:
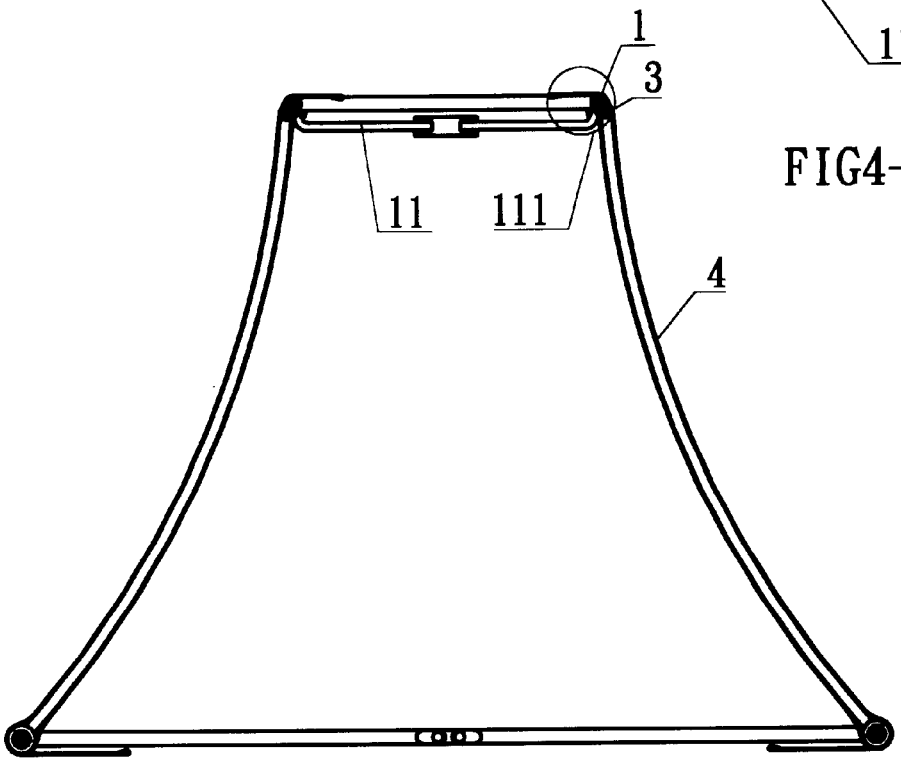

Referring to FIG. 4, the drawing of the invention herein when folded, when packaging, the frame members 3 must be first brought down flat and the bottom ring 2 is folded and, furthermore, as the framework is being folded, the lamp shade 4 collapses along with it, thereby achieving ease of assembly and, furthermore, minimizing storage area to effectively reduce shipping costs.

Figure 5:
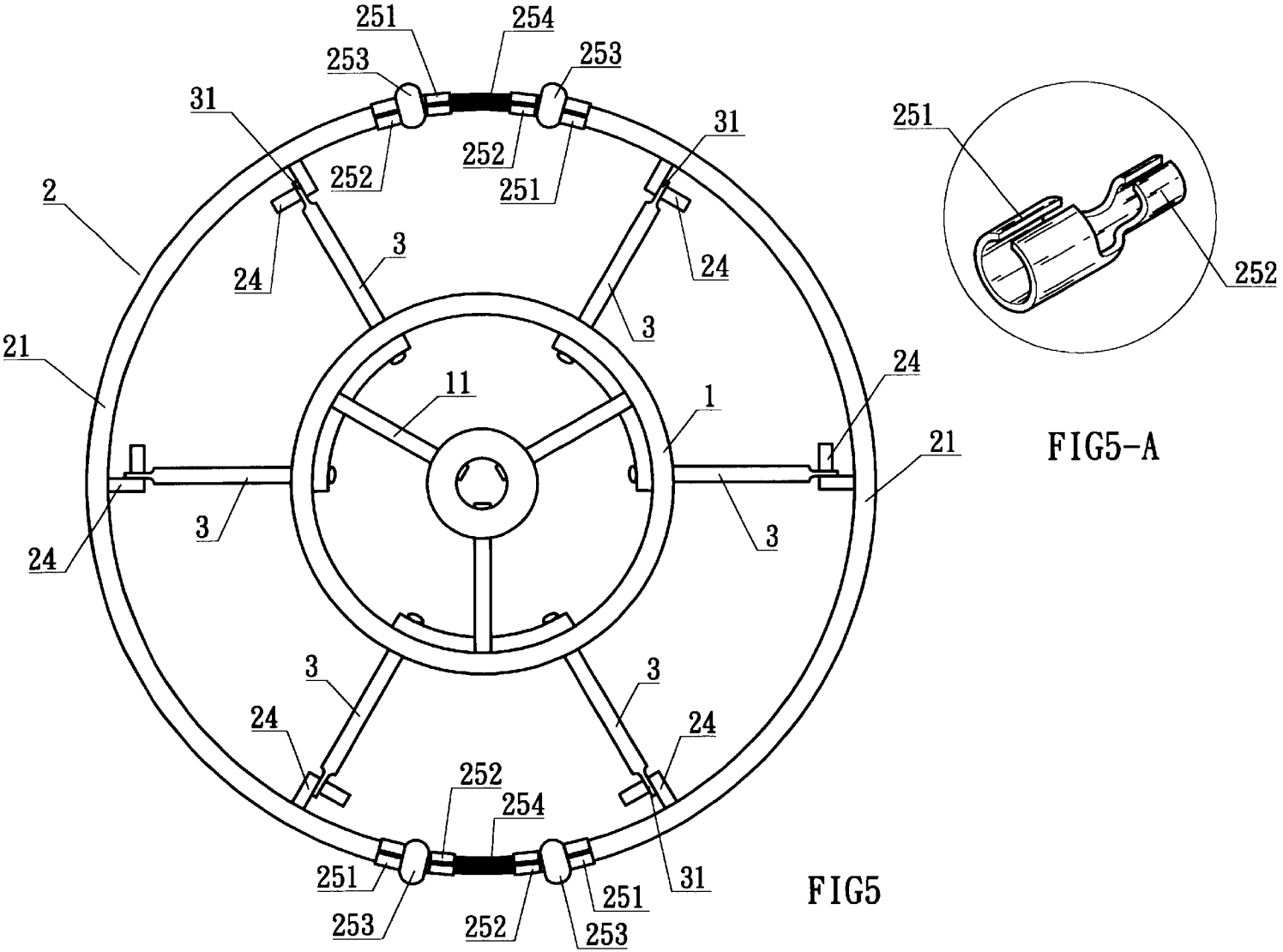
FIG. 5 is an orthographic drawing of another embodiment of the two-part bottom rod conjoining arrangement of the invention herein.
Figure 6:
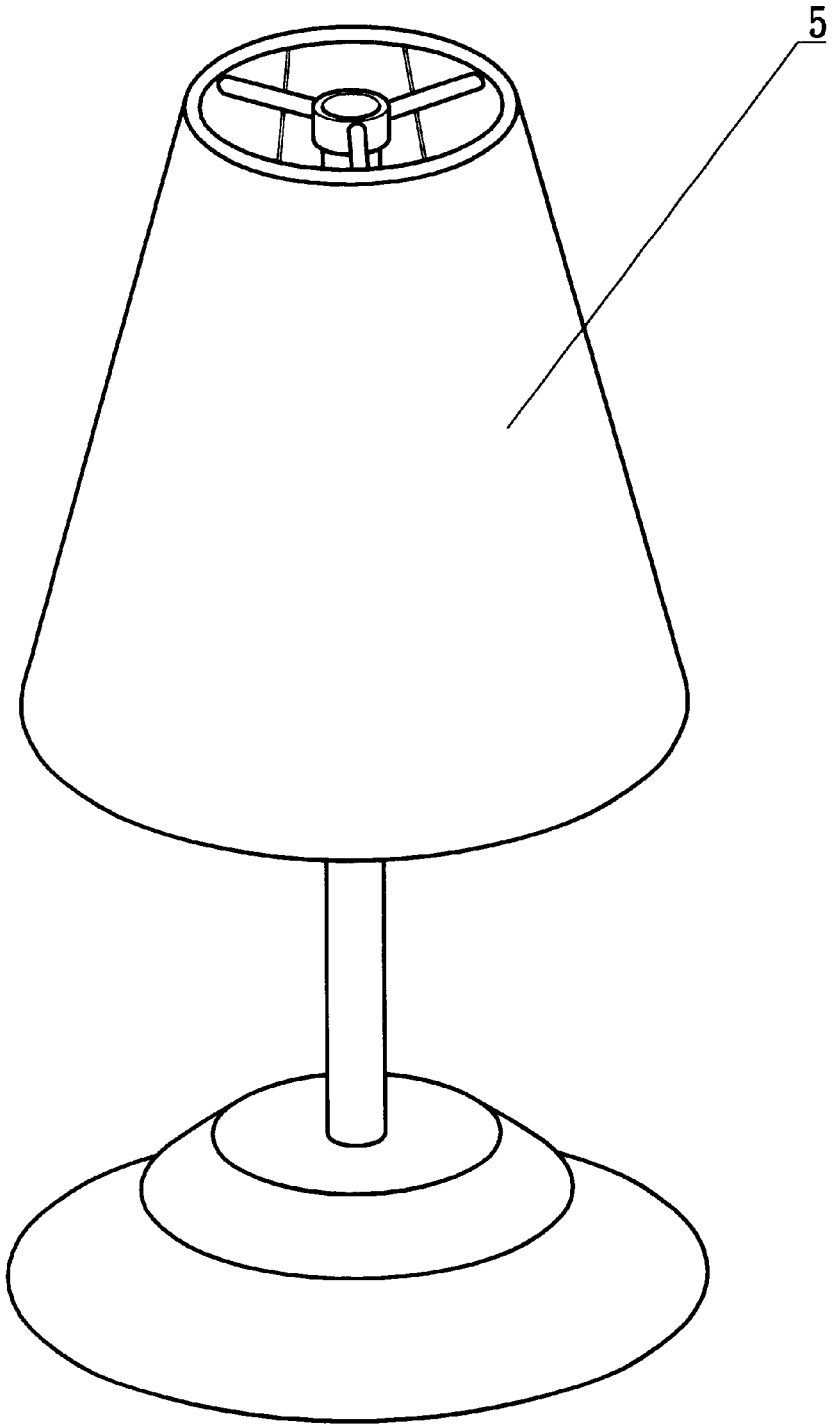
FIG6 PRIOR ART
FIG. 6 is an isometric drawing of a conventional lamp shade.

Referring to FIG. 5, the drawing of another embodiment of the invention herein, the said bottom ring 2 consists of a two-part bottom rod 21 having symmetrical left and right segments, fitted onto the free end at each of the opposing extremities is a coupling sleeve 25, the coupling sleeve 25 is punch molded and fabricated by bending into a structural arrangement consisting of two round sleeves, one small and one large; the large sleeve 251 is fitted onto each free end of the two-part bottom rod 21 and after being so installed, a keeper section 253 is pressure punched onto the free ends to prevent the separation of the sleeve from the bottom ring 2; elastic cordage 254 is installed on the opposing small sleeve 252 ends to provide for the folding of the two-part bottom rod 21 at the elastic cordage 254 position.

What is claimed is:

1. A variable-type lamp shade assembly comprising: a top ring at an uppermost end of the lamp shade, a bottom ring of larger circumference than the top ring, and frame members propped between the top ring and the bottom ring, wherein:

the top ring has support rods extending towards a center, the support rods being aligned with the frame members at a circumferential edge of the top ring, an enclosing space being formed by upward bending of the support rods to provide for positioning of top ends of the frame members thereagainst;

the bottom ring includes a two-part bottom rod having left and right symmetrical segments, joined at a coupling section of a flat shape, the coupling section including a hinge for folding the two-part bottom rod at the coupling section; the bottom ring including spaced apart curved retaining rods;

top ends of the frame members are positioned against the support rod in the enclosing spaces, the frame members including fastening sections of a flat shape disposed at bottom ends of the frame members and, each fastening section having a through-hole in a center engaged with one of the plurality of retaining rods.

2. A variable-type lamp shade assembly comprising a top ring, a bottom ring, a plurality of frame members, and a lamp shade, wherein:

the top ring has support rods extending towards a center, the support rods having, proximal to the frame members at a circumferential edge, enclosing spaces formed by upward bending providing for positioning the frame members thereagainst;

the bottom ring includes a two-part bottom rod having left and right symmetrical segments, the two-part bottom rod having a conjoinment area with a coupling section of a flat shape; the bottom ring; including spaced apart curved retaining rods;

the frame members have, at bottom sections, fastening sections, each with a through-hole is formed in a center thereof engaging one of the plurality of retaining rods;

the lamp shade has elastic tape at leading and trailing ends and is fitted over exterior peripheries of the frame members, wherein the said elastic tape is tightly secured around the top ring and the bottom ring.

3. The variable-type lamp shade of claim 1 wherein the coupling sections of the bottom ring has holes formed therein and includes a rivet inserted through the holes and a link connected thereto, thereby providing for folding of the two-part bottom rod at the coupling section.

4. The variable-type lamp shade of claim 1 further comprising, fitted onto a free end at each opposing extremity of the two-part bottom rod, is a coupling sleeve, wherein the coupling sleeve is punch molded and fabricated by bending into a structural arrangement including one small round sleeve and one large round sleeve, the large sleeve being fitted onto each free end of the two-part bottom rod; a keeper section is pressure punched onto the free ends to prevent the separation of the sleeves from the bottom ring; and elastic cordage is installed on the small sleeve at opposing ends to provide for the folding of the two-part bottom rod at the position of the elastic cordage.

5. The variable-type lamp shade of claim 2 wherein the coupling section of the bottom ring has holes formed therein and, includes a rivet inserted through the holes and a link connected thereto, thereby providing for folding of the two-part bottom rod at the coupling section.

6. The variable-type lamp shade of claim 2 further comprising, fitted onto a free end at each opposing extremity of the two-part bottom rod, is a coupling sleeve, wherein the coupling sleeve is punch molded and fabricated by bending into a structural arrangement including one small round sleeve and one large round sleeve, the large sleeve being fitted onto each free end of the two-part bottom rod; a keeper section is pressure punched onto the free ends to prevent the separation of the sleeves from the bottom ring; and elastic cordage is installed on the small sleeve at opposing ends to provide for the folding of the two-part bottom rod at the position of the elastic cordage.

* * * * *